US005620334A

United States Patent [19]

Quillet et al.

[11] Patent Number: 5,620,334

[45] Date of Patent: Apr. 15, 1997

[54] STRESS RELIEF DEVICE FOR CABLES ADAPTED TO BE REMOVABLY ATTACHED TO THE REAR OF A CONNECTOR

[75] Inventors: Thierry Quillet, Paris; Pascal Ribeau, Le Mans; Herve Le Gallic, Cherreau, all of France

[73] Assignee: Framatome Connectors International, Paris, France

[21] Appl. No.: 457,224

[22] Filed: Jun. 1, 1995

[30] Foreign Application Priority Data

Jun. 3, 1994 [FR] France ..... 94 06809

[51] Int. Cl.[6] ..... H01R 13/58

[52] U.S. Cl. ..... 439/471; 439/464

[58] Field of Search ..... 439/471, 470, 439/464, 468

[56] References Cited

U.S. PATENT DOCUMENTS

| | | | |
|---|---|---|---|
| 3,603,913 | 9/1971 | Hasty | 439/104 |
| 3,622,942 | 11/1971 | Rynk | 439/471 |
| 4,808,123 | 2/1989 | Dee et al. | 439/470 |
| 5,074,805 | 12/1991 | Kirma | 439/470 |

FOREIGN PATENT DOCUMENTS

| | | |
|---|---|---|
| 2558993 | 8/1985 | France . |
| 1391879 | 4/1975 | United Kingdom . |

*Primary Examiner*—Neil Abrams
*Assistant Examiner*—T. C. Patel
*Attorney, Agent, or Firm*—Perman & Green

[57] ABSTRACT

The device (1') of the invention comprises a clamp (10') and a ring (11) adapted to be screwed to a connector (2) to form a stress relief removably attached to the rear of the connector. In accordance with the invention, the clamp (11') has two parts: a rear part (102") forming a receptacle and a front part (102') which is open, having a "C" shape. The material of the clamp (10') is a composite material having elastic properties. By compressing it, the branches of the "C" can be moved closer together and the clamp (10') inserted in or removed from the ring (11). The clamp (11') also includes pegs (105) providing insertion abutments, preventing withdrawal of the ring (11). The clamp (10') can be straight or angled.

7 Claims, 3 Drawing Sheets

STRESS RELIEF DEVICE FOR CABLES ADAPTED TO BE REMOVABLY ATTACHED TO THE REAR OF A CONNECTOR

FIELD OF THE INVENTION

The invention concerns stress relief devices for cables designed to be removably attached to the rear of a connector.

BACKGROUND OF THE INVENTION

In the context of the present invention the term "cable" is to be understood in its widest sense. It encompasses all types of wired connections, whether the wires are individual or joined together by an insulative material, the whole forming a harness or the cable proper, with or without an outer protective jacket.

In many applications using cable harnesses, especially in the fields of automobiles and aeronautics, devices called stress reliefs are used to prevent excessive loads on the terminations. The harnesses are exposed to bending, stretching and other loads (various movements, vibration, etc.) which may be prejudicial to the reliability of the electrical connections. Also, in the applications mentioned above the number of connections is very large. The terminations of a cable harness are usually connected, by soldering or otherwise, to the contacts at the rear of a male or female connector. The latter is in turn attached to a complementary connector, for example by screwing them together.

The prior art includes stress relief devices for cables designed to be removably attached to the rear of a connector attached to the end of the cable harness which screw onto the rear end of the connector. There are two main configurations: a "straight" configuration, substantially aligned with the connector body, and an "angled" configuration, usually at 90°. The connector body has a screwthread at the rear onto which fits an internally screwthreaded ring. This ring traps the concentric body of the stress relief proper, forming a cable retaining clamp.

This assembly is usually completed by a cable tie type attachment for fixing the cable harness to the clamp.

Devices of this kind are described, by way of non-limiting example, in patents U.S. Pat. No. 5,074,805 (Safa Kirma) and GB-A-1 391 879 (Glenair Inc.)

It will be readily understood that once the terminations of the cable harness have been electrically connected to the contacts at the rear of the connector, by soldering for example, it is virtually impossible to release the clamp. The cable harness is usually installed in a cable duct of some kind and fixed to the latter along its length. The only solution is then to unscrew the ring retaining the clamp and to disconnect the terminations one by one, which usually means unsoldering them, possibly in an extremely small space. The working conditions are therefore less than optimal.

This type of operation may be needed to change from the aforementioned straight configuration to an angled configuration or vice-versa, for example.

While retaining the advantages of the prior art stress relief devices for cables designed to be removably attached to the rear of a connector, an object of the invention is to provide a device enabling easy mounting and demounting, without necessitating disconnection of the terminations of the cable harness connected to the contacts at the rear of the connector.

It also enables a change from a straight configuration of the rear body to an angled configuration, or vice-versa, under the same conditions.

To achieve this, in accordance with an important feature of the invention, the front part of the clamp is open, the latter having a "C" shape, and the material of the clamp has elastic properties so that the branches of the "C" can be compressed.

The invention therefore consists of a stress relief device for use between a connector and a cable harness, the device comprising a clamp having an open rear part forming a receptacle for the cables of said harness and an annular front part, and a ring having a particular inside diameter adapted to be fixed to the connector the ring having in its rear part an internal flange and in said front part an increased thickness periphery having a profile complementary to that of said internal flange to maintain the annular front part of the clamp in rearward abutment, characterized in that the material of the clamp has elastic properties and in that said front part of the clamp is open, this part having the shape of a "C" of which the facing two lips are separated by a distance e determined so that, when a compression force is applied to it, said lips can move towards each other by virtue of its elasticity sufficiently to enable insertion of said front part of the clamp inside the ring having said particular internal diameter.

BRIEF DESCRIPTION OF THE DRAWINGS

The invention will be better understood and other features and advantages of the invention will emerge from the following description with reference to the appended figures in which.

DETAILED DESCRIPTION OF THE INVENTION

Figure 1A:
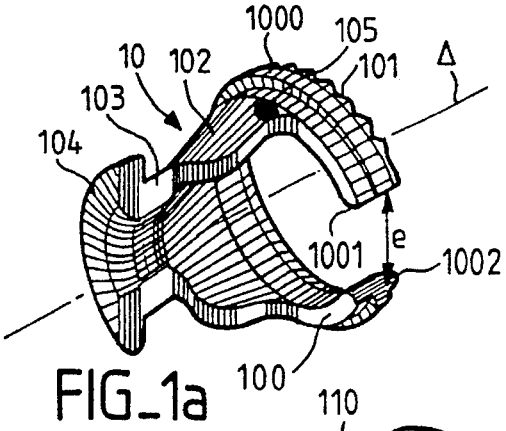
FIGS. 1*a*, 1*b*, and 1*c* show a straight configuration of a stress relief device of the invention designed to be removably attached to the rear of a connector, respectively in three-quarter rear view, three-quarter front view and partially cut away three-quarter rear view, with a clamping ring fitted.
Figure 1B:
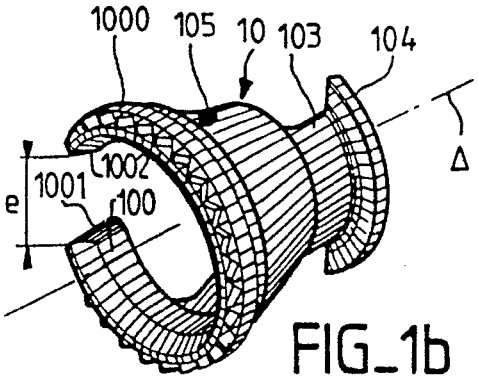
Figure 1C:
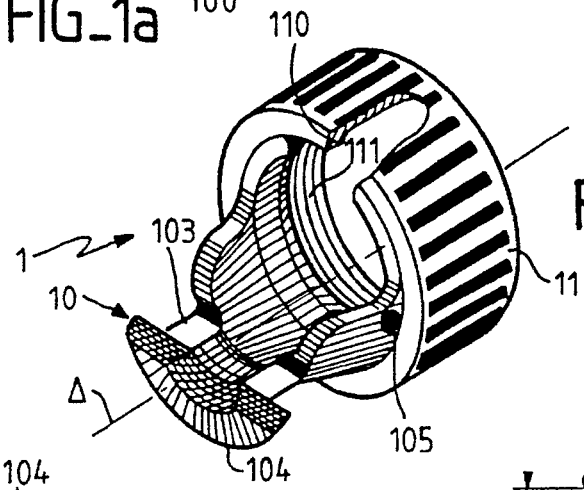

FIGS. 1*a* to 1*c* show one embodiment of a stress relief device designed to be removably attached to the rear of a connector in a so called "straight" configuration.

The device has two main parts:

a clamp 10; and a ring 11.

In this configuration the device 1 is at least partly symmetrical about an axis Δ of revolution.

According to one important feature of the invention the front part 100 of the clamp 10, differing in this regard from the prior art devices, is not in the form of a continuous ring but rather in the form of an open part which is substantially the shape of the letter "C". This "open" ring 100 has an increased thickness periphery 1000 forming a partial flange and, in the front part, in a preferred embodiment, teeth 101. There is a distance "e" between the two lips of the "C" shape part.

The body of the clamp 10 is extended towards the rear by a converging "C" shape part 102 ending at a narrow neck 103. Finally, the clamp 10 terminates at the rear in an increased thickness part forming a partial flange 104, advantageously circular in shape and inscribed within a circle whose diameter is greater than the outside diameter of the neck 103.

The ring 11 is provided with a rear flange 110 complementary in shape to the increased thickness periphery 1000. It also has an internal screwthread 111. When the ring 11 is screwed onto the screwthreaded rear part of a connector, as explained below, the flange 110 locks the clamp 10 against said connector, because of the increased thickness periphery 1000.

Finally, the median part 102 of the clamp 10 is preferably provided with at least one peg 105 (usually two pegs) whose function is also explained below.

The material of the clamp 10 is a composite material with elastic properties. The ring 11 can be made from the same material.

Figure 2A:
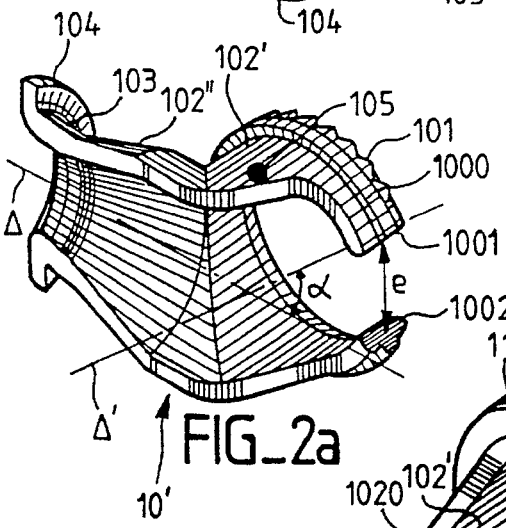
FIGS. 2*a*, 2*b*, and 2*c* show an angled configuration of a stress relief device of the invention designed to be removably attached to the rear of a connector, respectively in three-quarter rear view, three-quarter front view and partially cut away three-quarter rear view, with a clamping ring fitted.
Figure 2B:
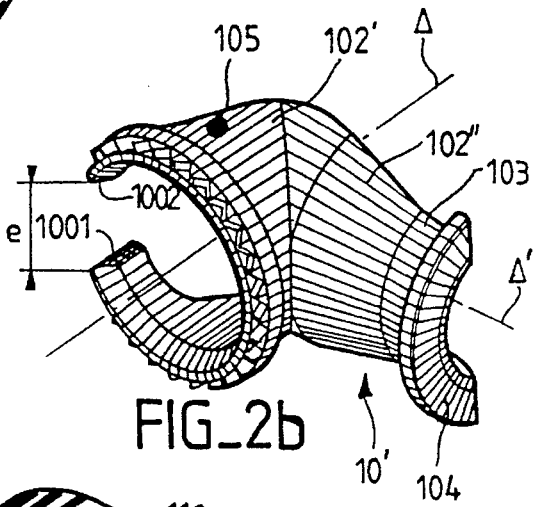
Figure 2C:
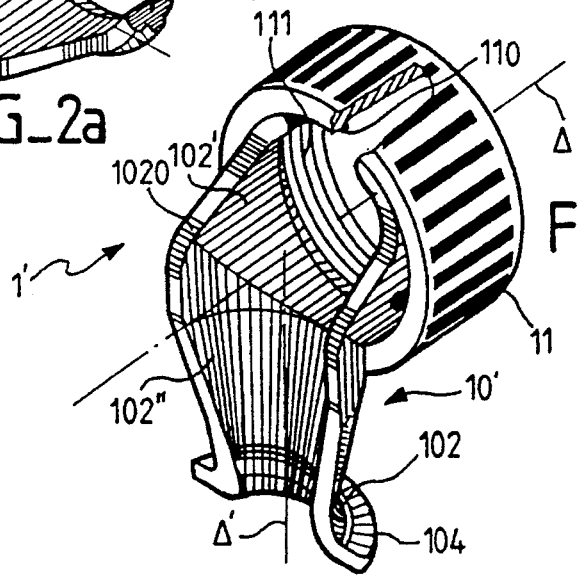

FIGS. 2*a*, 2*b*, and 2*c* show a second embodiment of a device of the invention, namely an angled configuration of the latter.

Parts common to both embodiments with the same or at least similar functions are identified by the same reference number and are described again only as and where necessary.

The only notable difference results from the fact that the intermediate part of the clamp body, identified by the reference number 10' in these figures, is angled. In the example shown it comprises two separate parts 102' and 102" extending in directions parallel to the axis Δ in the case of the intermediate part 102' at the front and to an axis Δ' in the case of the intermediate part 102" at the rear.

In the example shown the axes Δ and Δ' are at angle α to each other equal to 90° (FIG. 2*a*). It must be clearly understood that in no way is this value limiting on the scope of the invention, however.

In the example shown the surfaces of the two parts 102' and 102" merge at a sharp corner edge. Again, this is merely one possible technological choice available to the person skilled in the art, enabling simple manufacture of the body of the clamp 10', for example by moulding.

The steps of mounting or demounting a device 1 or 1' of the invention on a connector 2 will now be described with reference to FIGS. 3*a* through 4*b*. Parts common to the devices shown in FIGS. 1*a* through 2*c* having the same or at least similar functions are identified by the same reference number and are described again only as and where necessary. It is assumed that the overall shape of the connector 2 is a solid of revolution (or revolute structure) about an axis Δ.

In the example shown the device is one with the so called "angled" configuration. It is assumed that, during a preliminary step, the terminations 30 of the cable harness 3 have been connected to the contacts (not shown) at the rear of a connector 2, for example screw terminal type contacts. The connector 2 conventionally comprises a mobile front member 20 in the form of a ring with an internal screwthread (not shown) so that it can be screwed onto a complementary type connector (also not shown). The ring 20 advantageously has grooves 200 or similar members offering a better grip to the hand or to a tool.

When this preliminary operation has been done, the cable harness 3 extends in a direction substantially parallel to the axis Δ.

The ring 11 is threaded over the cable harness 3 first, of course.

Figures 3A, 3B, 3C, 3D:
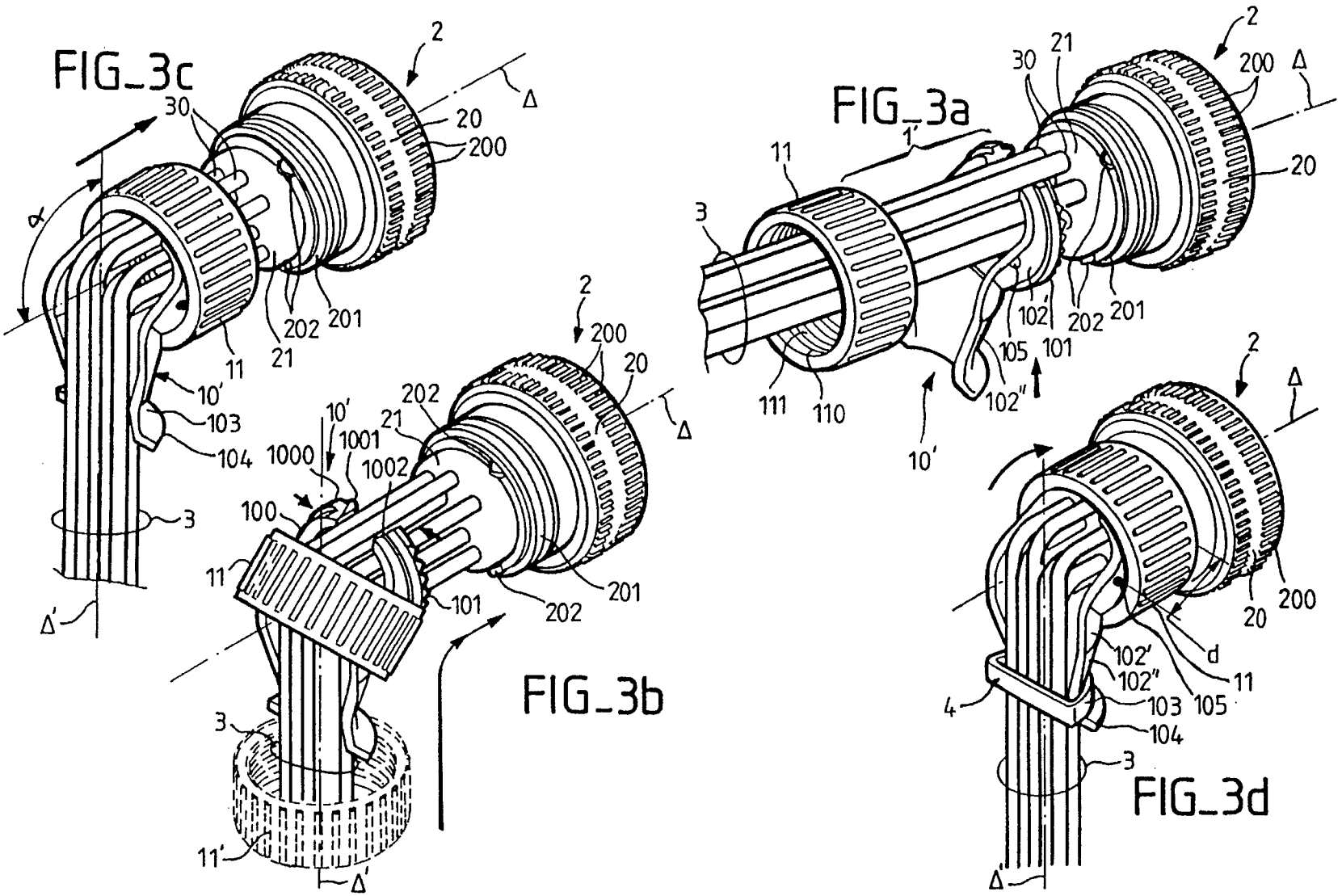
FIGS. 3*a* to 3*d* show four stages of fitting a device of the invention to a connector having a screwthread at the rear.

In the state shown in FIG. 3*a* the clamp 10' is close to the rear 21 of the connector 2. The clamp 10' is positioned so that the rear part 102" of the median part of its body is parallel to an axis Δ in a predetermined direction. The angle e between the axes Δ and Δ' is substantially 90° in the example shown.

As shown in FIG. 3*b* the cable harness is bent to press it against the inside of the clamp, in particular against the inside of the rear part of the intermediate area 102". The harness 3 then extends parallel to the direction defined by the axis Δ'. The ring has been moved back to the position 11' (shown in dashed outline) so that it is sufficiently far away from the clamp 10' not to impede the above bending operation. Said ring is then threaded (full line position 11) over the rear part of the clamp 10'. The relative dimensions of the inside diameter of the ring 11 and the components of the clamp 10' are naturally determined so that they enable this insertion. The "C" shape front part 100 of the clamp 10' is then compressed so that the lips 1001 and 1002 move towards each other. This can usually be done by hand, if the dimensions of the connector allow it. It is possible because the material of the clamp has elastic properties, as previously mentioned.

The distance "e" (see FIG. 2*a* or 2*b*) is determined to allow sufficient movement of the lips 1001 and 1002 towards each other to allow insertion of the peg 105 inside the flange 110. When the compression force is removed, the "C" part resumes its original size. The peg 105 then prevents removal of the ring 11 from the clamp. This position is shown in FIG. 1*c*.

The rear 21 of the connector 2 has pegs or teeth 201 on its exterior whose profile is complementary to that of the teeth 101 of the clamp 10, or at least adapted to engage in the latter. A single peg 202 is needed, but advantageously a plurality of pegs is provided, as shown, equi-angularly distributed over the periphery. This arrangement prevents rotation of the clamp 10' relative to the connector 2 when completely fitted to the connector by screwing it onto the rear thread of the latter, as shown in FIG. 3*d*. The distance "d" between the pegs and the rear 21 of the connector 2 must be greater than the thickness of the ring 11, when fully screwed on, to enable interengagement of the teeth 101 and the pegs 201.

The final stage is to fasten the cable harness 3 to the open inside of the clamp 10'. This is simple to achieve in the conventional way by means of a cable tie 4 wrapped around the cable harness 3 and the groove 103 of the clamp 10'.

The so called "angled" configuration of the clamp 10' has been chosen to illustrate the fitting of a device of the invention. It must be understood that this is an arbitrary choice, however. The stages of fitting a device with the so called "straight" configuration are entirely similar apart from the stage in which the cable harness 3 is bent.

The stages of demounting a clamp of the invention from a connector 2 will now be described with reference to figures 4*a* through 4*b*.

The so called "straight" configuration has been chosen for the clamp 10 this time, again entirely arbitrarily. The stages of demounting a clamp 10' with the so called "angled" configuration would be entirely similar.

It is assumed first of all that the cable tie 4 (not shown) has been removed beforehand. It can be a plastics material tie which is cut off with wire cutters, for example. This operation is entirely standard and there is no need to describe it further.

In the position with the clamp 10 mounted, the cable harness 3 extends parallel to the axis of symmetry Δ of the connector 2.

Figure 4A:
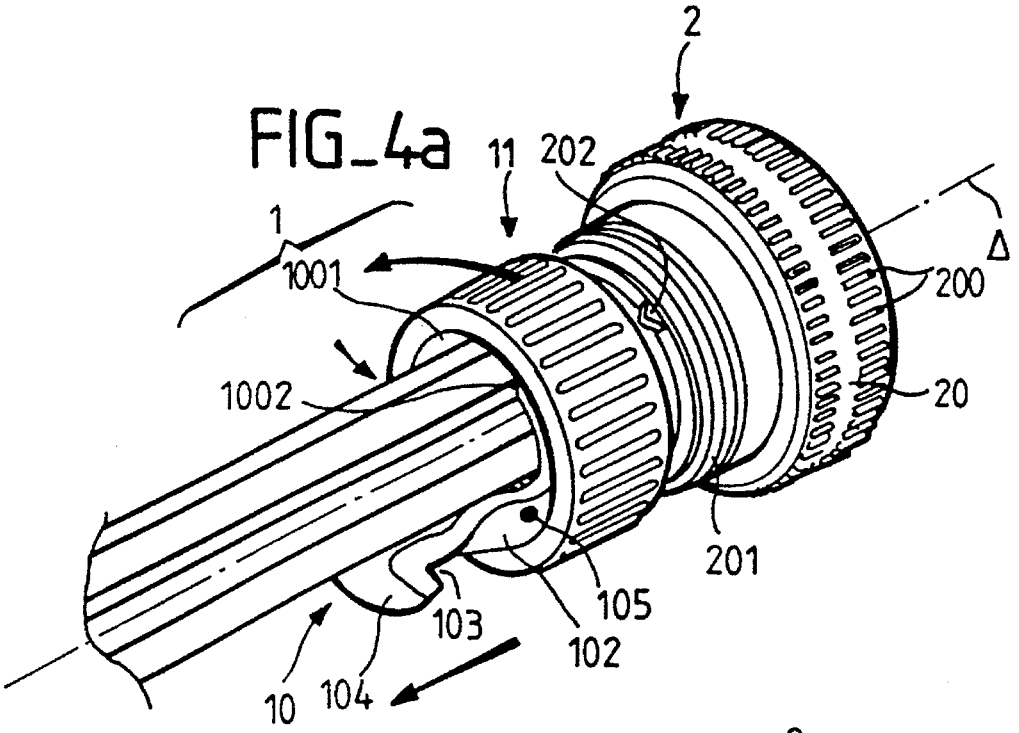
FIGS. 4*a* to 4*b* show two stages of demounting a device of the invention screwed to a connector of this kind.
Figure 4B:
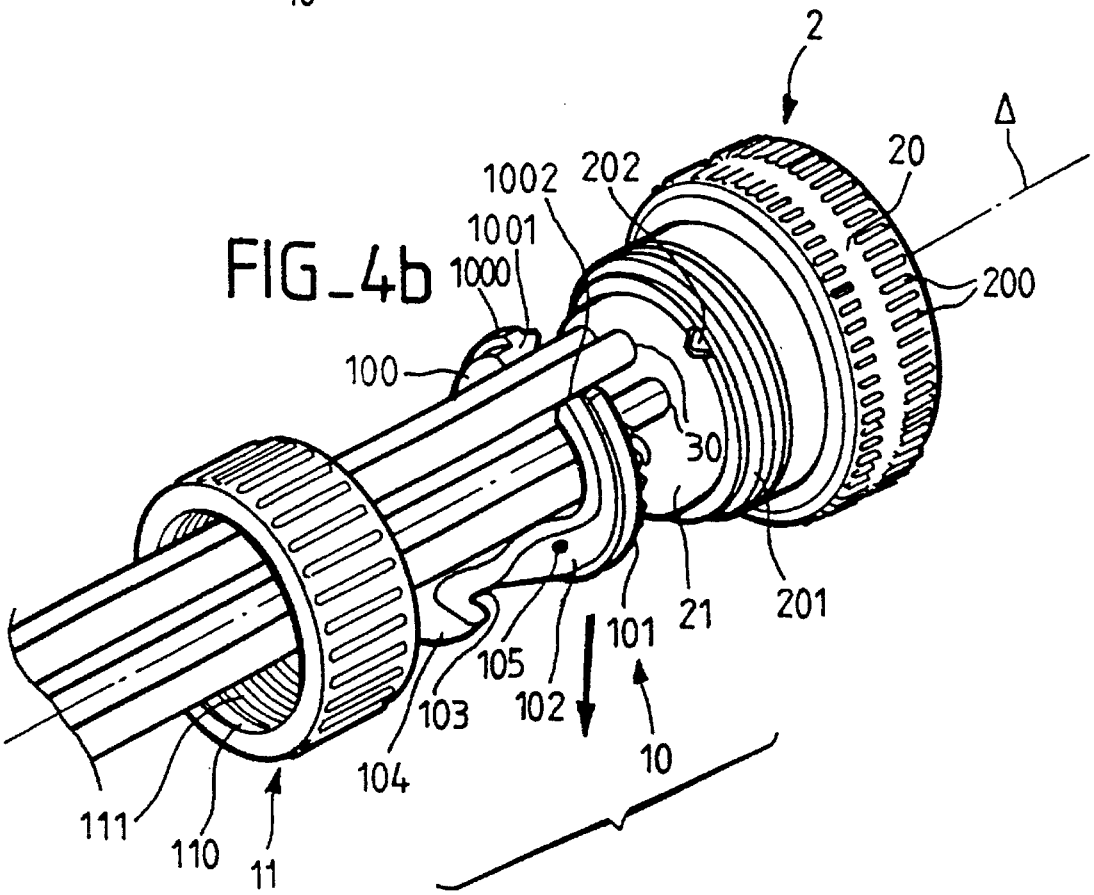

In the stage shown in FIG. 4*a* the ring 11 is first unscrewed from the rear screwthread 201 on the connector 2. The rear part 102 of the clamp 10 is compressed to move the lips 1001 and 1002 of the "C" shape front part 100 towards each other. The pegs 105 then enter the ring 11, passing under the flange 110. It is therefore possible to unscrew the ring 11 even though the clamp 10 and the connector 2 are inter-engaged with each other by virtue of the conjugate action of the teeth 101 and the pegs 202.

Once fully unscrewed, the ring 11 can slide along the cable harness 3. It then suffices to apply a traction force in a direction orthogonal to the axis Δ to the "C" shape front part 100 for the lips 1001 and 1002 to move apart slightly and allow the clamp 10 to leave its housing.

At this stage it is a simple matter to replace the "straight" configuration clamp 10 with a "angled" configuration clamp 10', by working through the mounting stages explained with reference to FIGS. 3*a* to 3*b*. This operation does not require any disconnection of the terminations 30 of the cable 3, unlike a prior art device. It must be understood that the ring 11 used for a "straight" clamp 10 is in every regard identical to that used for an "angled" clamp 10' (for the same design of connector 2, of course).

It is also important to note that in the case of the "angled" type clamp, it is possible to change the exit orientation of the cable harness 3 (the direction of the axis Δ'), also without disconnecting the terminations 30. It is sufficient to demount the clamp 10' as described in detail for the clamp 10' with reference to FIGS. 4*a* and 4*b*, to rotate the harness 3 about the axis Δ and to replace the clamp 10' in the new position (FIGS. 3*b* to 3*d*). Incidentally, it is not necessary to release the ring 11 completely (position 11' in FIG. 3*b* or position 11 in FIG. 3*a*).

The above description shows clearly that the invention achieves the stated objects. It enables easy mounting and demounting without requiring disconnection of the cable terminations. Among other things, it enables replacement of a "straight" type clamp by an "angled" clamp and changing the orientation of the cable harness 3 at the rear exit from the connector 2 without requiring any disconnection.

The composite material can be PBT, such as the material sold by GENERAL ELECTRIC under the tradename ULTEM, for example.

The invention finds particular applications in the fields of automobiles and aviation, which are fields in which cable harnesses comprise large numbers of connections.

However, although particularly well suited to these fields, the invention is not restricted to applications of these types.

It must also be made clear that the invention is not limited to the embodiments specifically described with reference to FIGS. 1 through 4*b*.

The connector to which the clamp is fixed can be of various configurations. In particular, it is not necessary for it to be of the type with a screw coupling at the front. It can be either a plug or a socket.

The material mentioned, although particularly well suited to the invention, is not the only material that can be used. Any appropriate material having appropriate mechanical strength and elasticity properties can be used to manufacture the clamp of the invention. The final choice of a specific material from among those which can be used will depend on technological considerations (mechanical strength, temperature resistance, etc.) and considerations of ease of manufacture and cost, all within the competence of the person skilled in the art.

The material of the ring can be the same as or different from that of the clamp, and can even be a metal.

What is claimed is:

1. A stress relief device (1, 1') for use between a connector (2), to the rear of which it can be removably attached, and a cable harness (3), the device (1, 1') comprising a clamp (10, 10') having an open rear part (102") forming a receptacle for the cables of said harness and an annular front part (102'), and a ring (11) having a particular inside diameter adapted to be fixed to the connector (2), the ring (11) having in its rear part an internal flange (110) and in said front annular part (102') an increased thickness periphery (1000) having a profile complementary to that of said internal flange (110) to maintain the annular front part (102') of the clamp (10, 10') in rearward abutment, characterized in that the material of the clamp (10, 10') has elastic properties and in that said front part (102') of the clamp (10, 10') is open, this part having the shape of a "C" of which the facing two lips (1001, 1002) are separated by a distance determined so that, when a compression force is applied to it, said lips (1001, 1002) can move towards each other by virtue of its elasticity sufficiently to enable insertion of said front annular part (102') of the clamp (10, 10') inside the ring (11) having said particular internal diameter, wherein said rear part (102") of the clamp (10, 10') includes at least one peg (105) projecting from its external surface so as to restrict forward movement of the clamp (10, 10') after insertion into the ring (11).

2. Device according to claim 1 characterized in that the front of said "C" shape front part (102') and the rear (21) of said connector (2) have complementary profile teeth (101, 202) in order to clip together in adjustable relative spatial positions.

3. Device according to claim 1 characterized in that the ring (11) has a screwthread (111) complementary to a screwthread (201) of said connector (2) so that the ring (11) can be screwed to the connector (2).

4. Device according to claim 1 characterized in that said rear part (202") of the clamp has a straight configuration.

5. Device according to claim 1 characterized in that said rear part (202") of the clamp has an angled configuration.

6. Device according to claim 1 characterized in that said rear part (202") of the clamp (10, 10') is extended rearwardly by an increased thickness area (104) forming an abutment to receive attachment means (4) fixing said cable harness (3) against the inside of the clamp (10, 10').

7. Device according to claim 1 characterized in that the material of the clamp (10, 10') is a composite material having elastic properties.

* * * * *